US007839258B2

(12) United States Patent
Cheng et al.

(10) Patent No.: US 7,839,258 B2
(45) Date of Patent: Nov. 23, 2010

(54) FUSE ASSEMBLY WITH A CAPABILITY OF INDICATING A FUSING STATE BY LIGHT

(76) Inventors: Wen-Tsung Cheng, No. 78 Chao-Chou St., Taoyuan (TW); Wen-Ho Cheng, No. 78 Chao-Chou St., Taoyuan (TW)

( * ) Notice: Subject to any disclaimer, the term of this patent is extended or adjusted under 35 U.S.C. 154(b) by 150 days.

(21) Appl. No.: 12/186,666

(22) Filed: Aug. 6, 2008

(65) Prior Publication Data

US 2010/0033293 A1 Feb. 11, 2010

(51) Int. Cl.
*H01H 85/32* (2006.01)
*H01H 85/30* (2006.01)

(52) U.S. Cl. ..... 337/242; 337/241; 337/265; 337/266

(58) Field of Classification Search ..... 337/241, 337/266, 242, 265
See application file for complete search history.

(56) References Cited

U.S. PATENT DOCUMENTS 3,588,775 A * 6/1971 Poehlman, Jr. ..... 337/226
4,281,322 A * 7/1981 Nasu et al. ..... 340/638
4,308,516 A * 12/1981 Shimada et al. ..... 337/241
4,391,485 A * 7/1983 Urani ..... 439/687
4,475,283 A * 10/1984 Olson et al. ..... 29/720
4,499,447 A * 2/1985 Greenberg ..... 337/266
4,661,807 A * 4/1987 Panaro ..... 340/638
4,695,815 A * 9/1987 Hwang ..... 337/266
4,712,081 A * 12/1987 Bosley ..... 337/266
4,772,219 A * 9/1988 Falchetti ..... 439/490
4,815,993 A * 3/1989 Falchetti ..... 439/620.33
4,941,851 A * 7/1990 Hsueh ..... 439/620.34
4,997,394 A * 3/1991 Katz et al. ..... 439/620.33
5,002,505 A * 3/1991 Jones et al. ..... 439/620.29
5,004,995 A * 4/1991 Lo ..... 337/266
5,055,071 A * 10/1991 Carlson et al. ..... 439/620.34
5,311,139 A * 5/1994 Fogal ..... 324/550
5,598,138 A * 1/1997 Jaronczyk, Jr. ..... 337/265
5,701,118 A * 12/1997 Hull et al. ..... 340/638
5,874,884 A * 2/1999 Hull et al. ..... 337/241
6,054,915 A * 4/2000 Rowton et al. ..... 337/216
6,144,284 A * 11/2000 Santa Cruz et al. ..... 337/242
6,157,287 A * 12/2000 Douglass et al. ..... 337/198
6,373,370 B1 * 4/2002 Darr et al. ..... 337/243
6,448,897 B1 * 9/2002 Ku ..... 340/638
6,542,061 B2 * 4/2003 Santa Cruz et al. ..... 337/79
6,587,028 B2 * 7/2003 Mollet et al. ..... 337/194
6,775,148 B2 * 8/2004 Hong ..... 361/752
6,836,206 B2 * 12/2004 Lee ..... 337/243
7,049,973 B2 * 5/2006 Torrez et al. ..... 340/638
7,126,488 B1 * 10/2006 May ..... 340/638
7,339,486 B2 * 3/2008 Huang ..... 340/638
7,385,518 B2 * 6/2008 Torrez et al. ..... 340/638
7,394,343 B2 * 7/2008 Cheng et al. ..... 337/265

(Continued)

*Primary Examiner*—Anatoly Vortman
(74) *Attorney, Agent, or Firm*—Chun-Ming Shih; HDLS IPR Services

(57) ABSTRACT

A fuse assembly capable of indicating whether the fuse is blown or not includes a fuse body formed therein with an accommodating space. The accommodating space is provided with two conductive terminals connected to each other via a metallic fuse. A light-emitting diode is inserted into an accommodating hole of the fuse body, thereby electrically connecting two electrodes of the light-emitting diode to the two conductive terminals. By the above arrangement, the light-emitting diode can be lighted up when the fuse body is blown.

5 Claims, 5 Drawing Sheets

U.S. PATENT DOCUMENTS

| | | | | |
|---|---|---|---|---|
| 7,460,004 | B1 * | 12/2008 | Yang | 337/206 |
| 7,570,147 | B2 * | 8/2009 | Muller | 337/206 |
| 2003/0179070 | A1 * | 9/2003 | Izumi | 337/255 |
| 2004/0017203 | A1 * | 1/2004 | Becker et al. | 324/507 |
| 2005/0035842 | A1 * | 2/2005 | Shyu | 337/265 |
| 2006/0017540 | A1 * | 1/2006 | Smith | 337/242 |
| 2007/0109090 | A1 * | 5/2007 | Cheng et al. | 337/123 |
| 2010/0019878 | A1 * | 1/2010 | Darr et al. | 337/198 |

* cited by examiner

FUSE ASSEMBLY WITH A CAPABILITY OF INDICATING A FUSING STATE BY LIGHT

BACKGROUND OF THE INVENTION

1. Field of the Invention

The present invention relates to a fuse, and in particular to a fuse assembly with a function of indicating a state of a fuse by light.

2. Description of Prior Art

The fuse is an over-current protection device that is widely used in electronic products or circuits. When the electronic product suffers damage or the circuit is in an abnormal state, the current will rise instantaneously. When the current flowing through the fuse exceeds its maximum capacity, the fuse will be blown to prevent the excessive current from damaging the electronic elements within the electronic product. Therefore, the fuse can protect the electronic product and can be used to check a circuit.

In practice, more than one fuse is used in an electronic product. A car or a large-scale power-distributing apparatus is provided with rows of fuses, thereby protecting the electronic elements against an over-current respectively. However, when one of the fuses is blown or needs to be replaced or checked, the operator has to check the rows of fuses one by one, which causes a lot of inconvenience in use.

Therefore, a fuse assembly combined with a light-emitting body is proposed. The light-emitting body is provided with a casing of the fuse assembly. Specifically, the light-emitting body is disposed between two metallic conductive pieces and in parallel to the fuse. In a normal state, the current only flows through the fuse without passing through the light-emitting body, so that the light-emitting body does not illuminate. When the fuse is blown due to an over-current, the current will flow through the light-emitting body, so that the light-emitting body illuminates to indicate the blowing of the fuse. In this way, it is convenient for the operator to check and replace the damaged fuses.

However, in practice, the above-mentioned fuse assembly still has some drawbacks as follows. Since the light-emitting body is inserted and accommodated in the casing of the fuse assembly, when a fuse is blown, the light-emitting body is thrown away together with the damaged fuse, which causes the waste of materials and money. Especially, in order to conform to the requirement for environmental protection, it is necessary to improve such a fuse assembly. On the other hand, the manufacturing procedure of mounting the light-emitting body within the fuse assembly is more complicated. Also, the cost of assembling is larger.

Therefore, it is an important issue for the present Inventor to overcome the above problems.

SUMMARY OF THE INVENTION

The present invention is to provide a fuse assembly with a function of indicating a state of a fuse by light, whereby light-emitting diodes can be recycled to reduce the material cost and the requirement for environmental protection can be satisfied.

The present invention is to provide a fuse assembly with a function of indicating a state of a fuse by light, whereby the manufacturing process can be simplified to reduce the manufacturing and assembling cost.

The present invention is to provide a fuse assembly with a function of indicating a state of a fuse by light, which includes a fuse body formed therein with an accommodating space, a side surface of the fuse body being provided with an accommodating hole; two conductive terminals accommodated in the accommodating space of the fuse body; and a light-emitting diode inserted into the accommodating hole of the fuse body, thereby electrically connecting the light-emitting diode to the two conductive terminals. By the above arrangement, the light-emitting diode can be lighted up when the fuse body is blown.

DETAILED DESCRIPTION OF THE INVENTION

The detailed description and technical contents of the present invention will be explained with reference to the accompanying drawings. However, the drawings are illustrative only but not used to limit the present invention.

Figure 1:
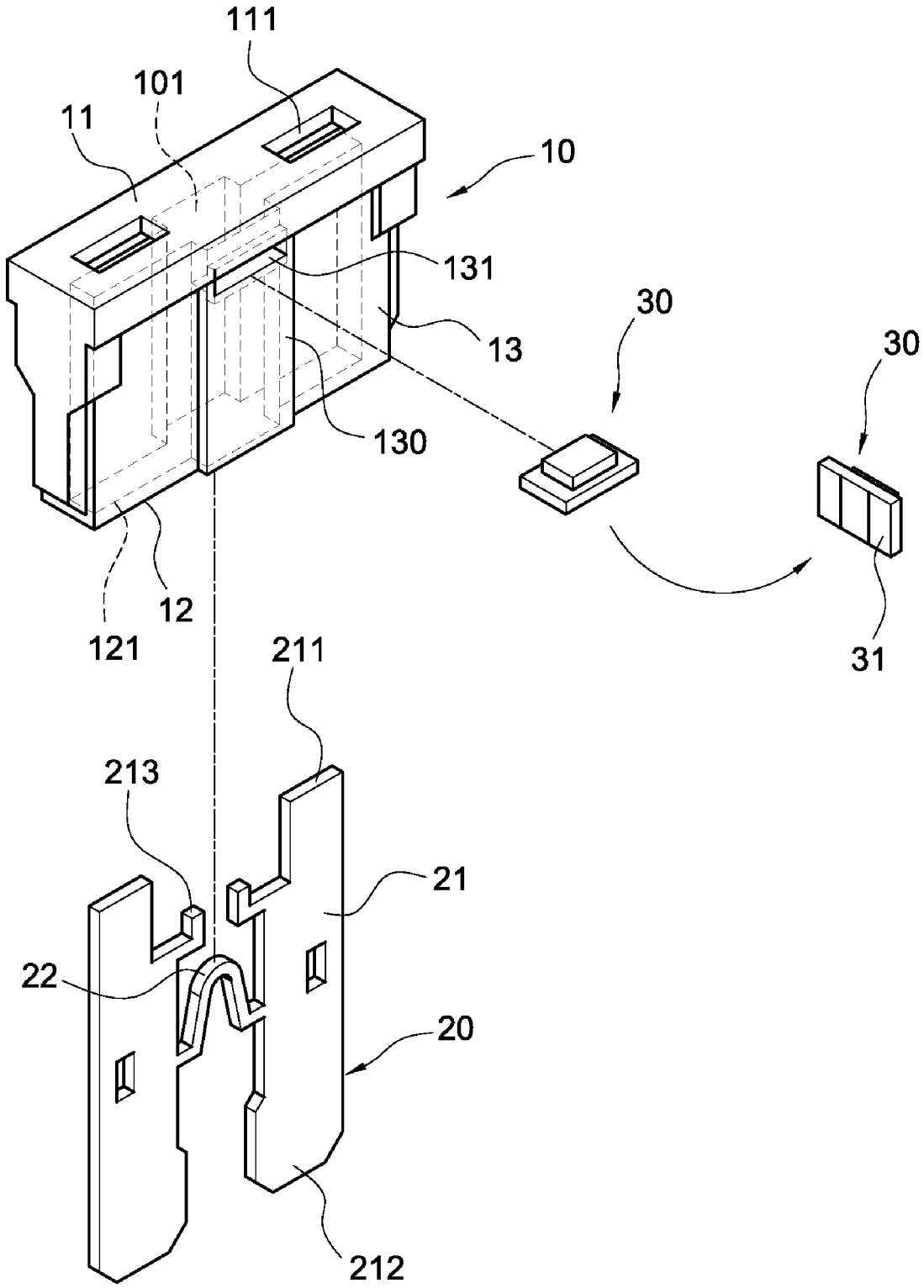
FIG. 1 is an assembled perspective view showing an embodiment of the present invention.

Please refer to FIG. 1 first, which is an assembled perspective view of the present invention. The present invention provides a fuse assembly with a function of indicating a state of a fuse by light, which includes a fuse body 10. A top surface 11 of the fuse body 10 is provided with two troughs 111 arranged in a straight line, and a bottom surface 12 thereof is provided with an open trough 121. A side surface 13 of the fuse body 10 is formed into a convex surface 130, on which an accommodating hole 131 is provided. In addition, the interior of the fuse body 10 is formed with an accommodating space 101 in communication with the two troughs 111, the open trough 121 and the accommodating hole 131. The accommodating space 101 of the fuse body 10 is configured to accommodate a metallic piece 20. The metallic piece 20 includes two conductive terminals 21. The two conductive terminals 21 are connected with each other via a metallic fuse 22. The side surfaces of the two conductive terminals 21 are formed with elastic contacting arms 213 above the metallic fuse 22 respectively. The top ends 211 of the two conductive terminals 21 are inserted into the two troughs 111 of the fuse body 10. Pins 212 of the two conductive terminals 21 penetrate the open trough 121 of the fuse body 10. The accommodating hole 131 of the fuse body 10 is provided therein with a light-emitting diode 30, so that a conductive surface 31 of the light-emitting diode 30 is brought into contact with the two contacting arms 213 of the metallic piece 20. In this way, two electrodes of the light-emitting diodes 30 can be electrically connected with the two conductive terminals 21 respectively.

Figure 2:
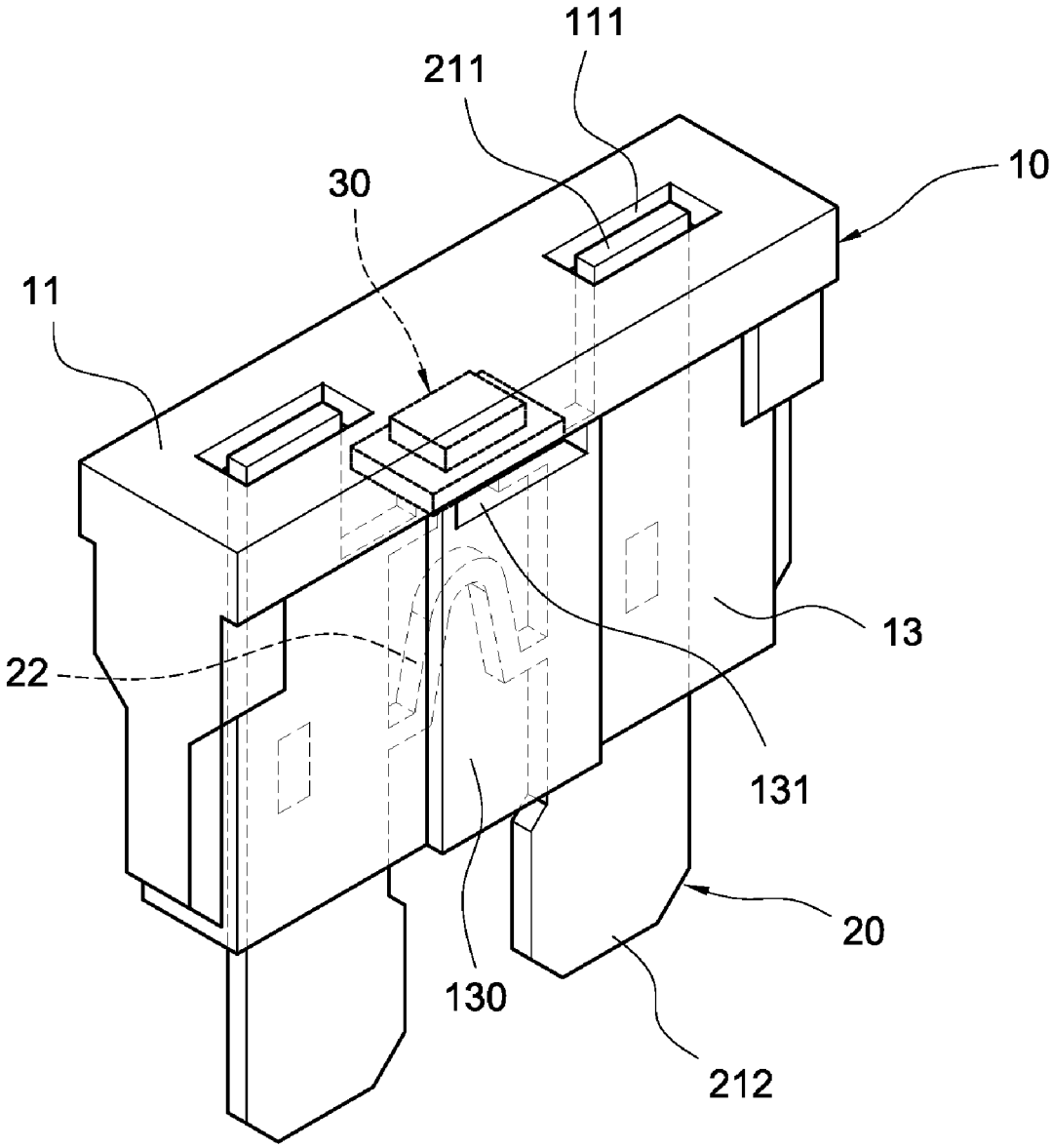
FIG. 2 is a perspective view showing the external appearance of an embodiment of the present invention.
Figure 3:
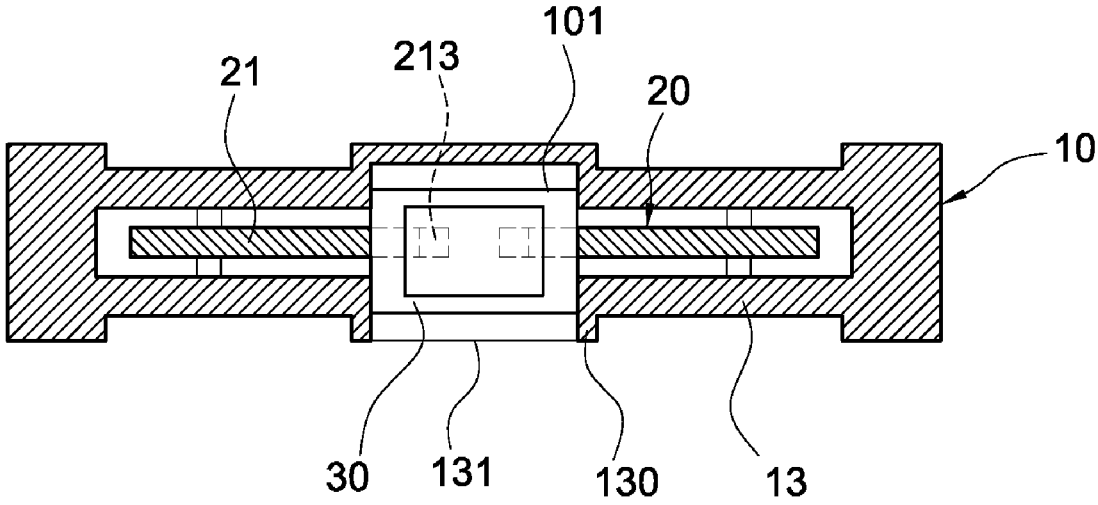
FIG. 3 is an assembled cross-sectional view showing an embodiment of the present invention.
Figure 4:
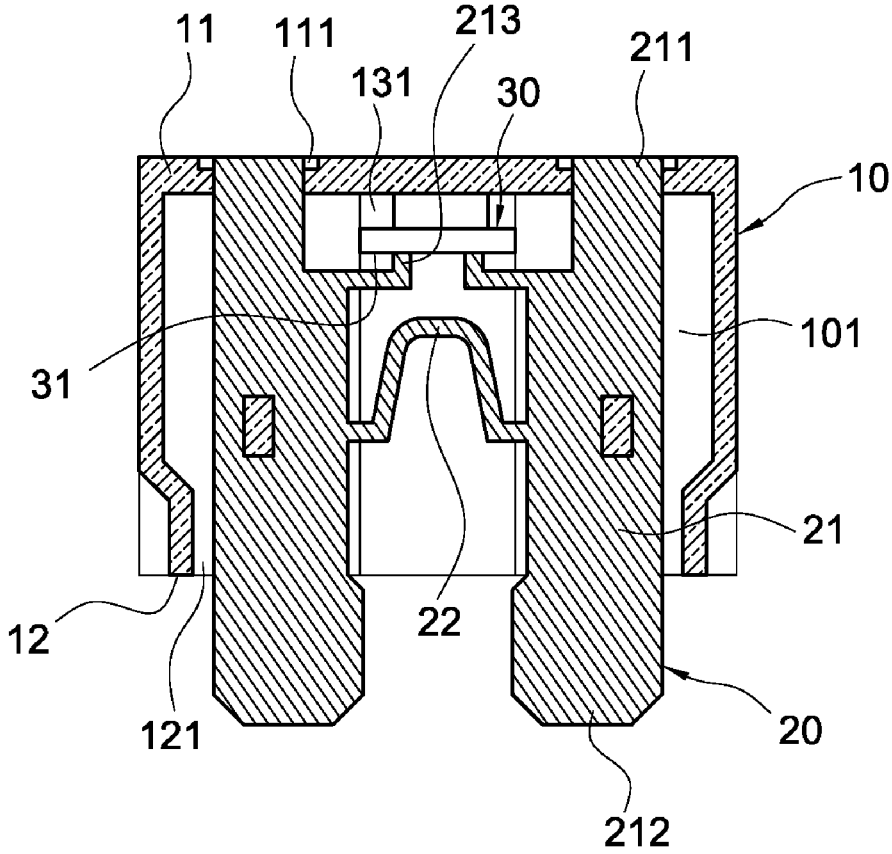
FIG. 4 is an assembled cross-sectional view showing another side of an embodiment of the present invention.

Please refer to FIGS. 2 to 4. FIG. 2 is a perspective view showing the external appearance of the present invention, FIG. 3 is an assembled cross-sectional view, and FIG. 4 is an assembled cross-sectional view showing another side of the present invention. The metallic piece 20 is inserted into the accommodating space 101 of the fuse body 10 in such a manner that the top ends 211 of its two conductive terminals 21 are inserted into the two troughs 111 of the fuse body 10.

The pins 212 of the two conductive terminals 21 penetrate the bottom surface 12 of the fuse body 10. The light-emitting diode 30 is disposed on the contacting arms 213 of the two conductive terminals 21 via the accommodating hole 131 of the fuse body 10, thereby electrically connecting the two electrodes on a conductive surface 31 of the light-emitting diode 30 to the two conductive terminals 21. Since the two contacting arms 213 are elastic, when the light-emitting diode 30 is disposed in the accommodating hole 131, the two contacting arms 213 can be bent slightly to sandwich the light-emitting diode 30 between the top surface 11 of the fuse body 10 and the contacting arms 213. In this way, the top surface of the light-emitting diode 30 can exactly abut the underside of the top surface 11 of the fuse body 10 without falling down, so that the light-emitting diode 30 can be inserted into or pulled out of the accommodating hole 131 of the fuse body 10. Furthermore, after the light-emitting diode 10 is disposed in the accommodating hole 131, the side surface of the light-emitting diode 30 is located below or in flush with the convex surface 131 of the side surface 13 of the fuse body 10.

Figure 5:
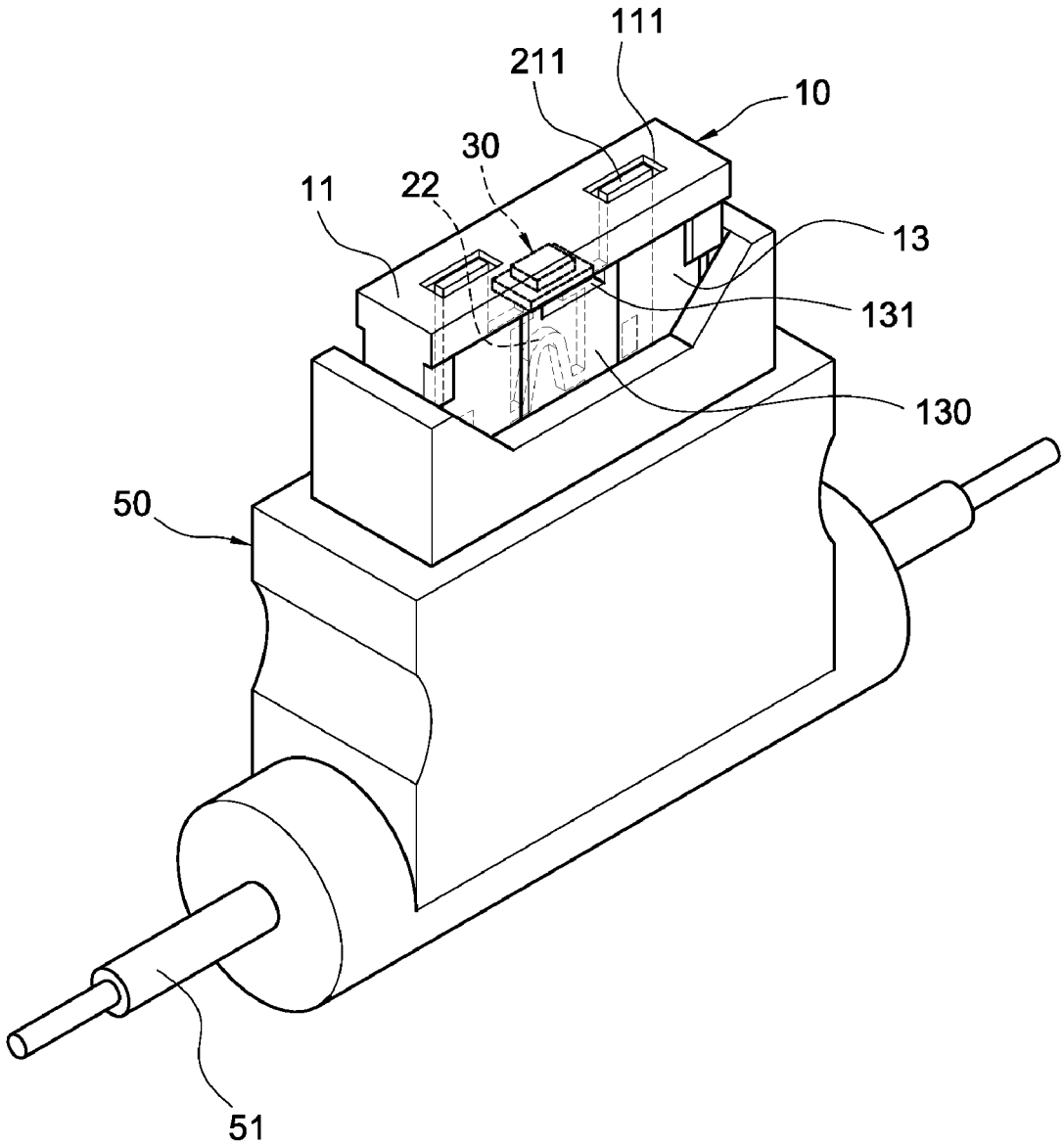
FIG. 5 is a schematic view showing the operating state of an embodiment of the present invention.

Please refer to FIG. 5, which is a schematic view showing the operating state of the fuse assembly with a function of indicating a state of a fuse by light according to the present invention. In use, the fuse is inserted into a fuse base 50. The interior of the fuse base 50 is provided with conductive pieces (not shown). After the fuse is inserted into the fuse base 50, the conductive pieces are electrically connected to the pins 212 of the two conductive terminals 21 of the fuse (FIG. 1). Both sides of the fuse base 50 are provided with a power line 51 respectively. After a power source is connected, in a normal state, the current will pass through the metallic fuse 22 of the fuse body. Therefore, in the normal state, the light-emitting diode 30 does not illuminate. When the electrical product suffers damage or the circuit is in an abnormal state, the instantaneously-rising current will blow the metallic fuse 22. After the metallic fuse 22 is blown, the current can only pass through the light-emitting diode 30 and thus the light-emitting diode is lighted up. The light emitted by the light-emitting diode 30 pierces the fuse body 10, thereby indicating the blowing of the fuse. Therefore, it is convenient for an operator to replace and check the damaged fuse.

Figure 6:
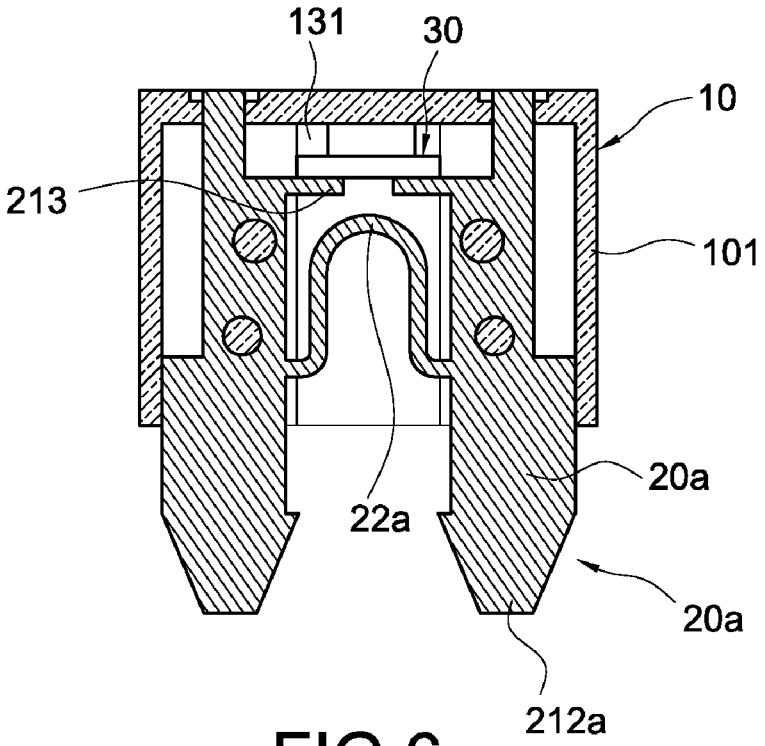
FIG. 6 is an assembled cross-sectional view showing a second embodiment of the present invention.
Figure 7:
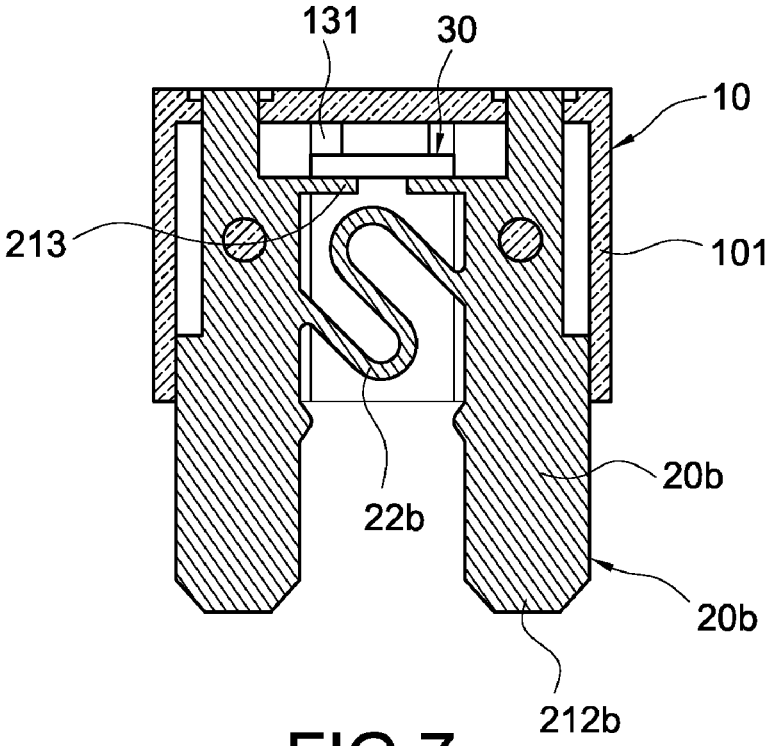
FIG. 7 is an assembled cross-sectional view showing a third embodiment of the present invention.

Please refer to FIGS. 6 and 7. FIG. 6 and FIG. 7 show the second and the third embodiments of the fuse assembly with a function of indicating a state of a fuse by light according to the present invention respectively. The second and third embodiments are substantially identical to the first embodiment, and the light-emitting diode 30 is similarly inserted into the accommodating hole 131 of the fuse body 10. The difference between these two embodiments and the first embodiment lies in the metallic pieces 20*a*, 20*b* inserted into the accommodating space 101 of the fuse body 10. The metallic pieces 20*a*, 20*b* consist of two conductive terminals 21*a*, 21*b*. The pins 212*a*, 212*b* of the two conductive terminals 21*a*, 21*b* and the metallic fuses 22*a*, 22*b* are slightly different from those of the first embodiment in their forms. However, each of these three embodiments has the same function of indicating a state of a fuse by light.

Therefore, according to the present invention, after the fuse is blown, the light-emitting diode 30 can be taken out of the accommodating hole 131 of the fuse body 10, thereby recycling the light-emitting diode 30 to reduce the material cost and conform to the requirement for environmental protection. Furthermore, the assembling procedure of the light-emitting diode 30 is simple, so that the manufacturing procedure of the present invention is also simplified and the manufacture cost is reduced. Therefore, the present invention has great practicability and economic benefits.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A fuse assembly comprising;

a fuse body formed therein with an accommodating space, a side surface of the fuse body being provided with an accommodating hole;

two conductive terminals accommodated in the accommodating space of the fuse body, an elastic contacting arm being formed on a side surface of each conductive terminal; and a light-emitting diode inserted into the accommodating hole of the fuse body to be disposed on the two elastic contacting arms, as the two contacting arms are elastic when the light-emitting diode is disposed in the accommodating hole the two contacting arms can be bent slightly to sandwich the light-emitting diode between a top surface of the fuse body and the contacting arms so that a top surface of the light-emitting diode abuts the underside of the top surface of the fuse body, thereby electrically connecting the light-emitting diode to the two conductive terminals.

2. The fuse assembly according to claim 1, wherein the top surface of the fuse body is provided with two troughs, the bottom surface of the fuse body is provided with an open trough, the accommodating space is in communication with the two troughs, the open trough and the accommodating hole.

3. The fuse assembly according to claim 2, wherein the two troughs of the fuse body are arranged in a straight line.

4. The fuse assembly according to claim 1, wherein the two conductive terminals are made of a metallic piece, the two conductive terminals are connected to each other via a metallic fuse and pass through the open trough of the fuse body.

5. The fuse assembly according to claim 1, wherein the side surface of the fuse body is formed with a convex surface, and the convex surface is provided with the accommodating hole.

* * * * *